US012650254B2

(12) United States Patent
Van Beek et al.

(10) Patent No.: US 12,650,254 B2
(45) Date of Patent: Jun. 9, 2026

(54) FOUR-WAY REVERSING VALVE FOR A HIGH CAPACITY REVERSIBLE HEAT PUMP COMPRESSOR

(71) Applicant: Danfoss A/S, Nordborg (DK)

(72) Inventors: Johan Van Beek, Almind (DK); Michael Birkelund, Middelfart (DK); Uwe Maywald, Nordborg (DK)

(73) Assignee: DANFOSS A/S, Nordborg (DK)

( * ) Notice: Subject to any disclaimer, the term of this patent is extended or adjusted under 35 U.S.C. 154(b) by 101 days.

(21) Appl. No.: 18/574,441

(22) PCT Filed: Jul. 1, 2022

(86) PCT No.: PCT/EP2022/068351
§ 371 (c)(1),
(2) Date: Dec. 27, 2023

(87) PCT Pub. No.: WO2023/275398
PCT Pub. Date: Jan. 5, 2023

(65) Prior Publication Data

US 2024/0288203 A1 Aug. 29, 2024

(30) Foreign Application Priority Data

Jul. 2, 2021 (EP) ..... 21183550

(51) Int. Cl.
*F25B 41/26* (2021.01)

(52) U.S. Cl.
CPC ..... *F25B 41/26* (2021.01)

(58) Field of Classification Search
CPC ..... F25B 41/26; Y10T 137/86839
See application file for complete search history.

(56) References Cited

U.S. PATENT DOCUMENTS 2,693,930 A 11/1954 Carter
4,112,974 A 9/1978 Davis et al.
(Continued)

FOREIGN PATENT DOCUMENTS

CN 1633570 A 6/2005
CN 101036010 A 9/2007
(Continued)

OTHER PUBLICATIONS

International Search Report mailed Jul. 27, 2022, in connection with corresponding International Application No. PCT/EP2022/068351; 3 pages.

*Primary Examiner* — Michael R Reid
(74) *Attorney, Agent, or Firm* — McCormick, Paulding & Huber PLLC

(57) ABSTRACT

A four-way reversing valve for a high capacity reversible heat pump compressor includes a housing with four ports, namely a discharge port, a suction port, an evaporator port and a condenser port. It further includes a conically shaped rotor provided rotatably inside the housing for varying flow paths between the four ports, wherein a large diameter face of the rotor comprises two separated openings, wherein a first opening fluidly connects the large diameter face to a small diameter face of the rotor via a first fluid conduit and a second opening fluidly connects the large diameter face to a radially outer portion of the rotor via a second fluid conduit. The disclosure further discloses a set having two or more four-way reversing valves.

24 Claims, 13 Drawing Sheets

(56) References Cited

U.S. PATENT DOCUMENTS

| | | | |
|---|---|---|---|
| 4,203,469 | A | 5/1980 | Gates |
| 5,507,315 | A * | 4/1996 | Parker ..... F16K 11/0743 137/1 |
| 6,293,513 | B1 | 9/2001 | Birkelund |
| 6,386,089 | B2 | 5/2002 | Giversen et al. |
| 6,405,824 | B1 | 6/2002 | Sørensen et al. |
| 6,459,348 | B1 | 10/2002 | Birkelund |
| 6,668,967 | B2 | 12/2003 | Sørensen et al. |
| 6,698,452 | B2 | 3/2004 | Sisk et al. |
| 6,912,455 | B2 | 6/2005 | van Beek |
| 6,955,331 | B2 | 10/2005 | Larsen et al. |
| 7,631,661 | B2 | 12/2009 | Moreno |
| 7,895,850 | B2 | 3/2011 | Kitsch |
| 8,066,256 | B2 | 11/2011 | Platz et al. |
| 8,434,734 | B2 | 5/2013 | Birkelund |
| 8,689,582 | B2 | 4/2014 | Birkelund et al. |
| 8,820,356 | B2 | 9/2014 | Kannoo |
| 9,360,027 | B2 | 6/2016 | Birkelund |
| 9,416,890 | B2 | 8/2016 | Nissen et al. |
| 9,683,673 | B2 | 6/2017 | Gretarsson et al. |
| 10,082,219 | B2 | 9/2018 | Birkelund |
| 10,197,314 | B2 | 2/2019 | Birkelund |
| 10,253,788 | B2 | 4/2019 | Birkelund |
| 10,330,359 | B2 | 6/2019 | Yu |
| 10,443,753 | B2 | 10/2019 | van Beek et al. |
| 10,544,957 | B2 | 1/2020 | Takeichi |
| 10,571,156 | B2 | 2/2020 | Birkelund |
| 10,663,077 | B2 | 5/2020 | Birkelund |
| 10,816,015 | B2 | 10/2020 | Birkelund |
| 10,989,454 | B2 | 4/2021 | Uribe et al. |
| 11,365,919 | B2 | 6/2022 | Lund et al. |
| 2006/0037654 | A1 | 2/2006 | Moreno |
| 2015/0377378 | A1 | 12/2015 | Birkelund et al. |
| 2021/0164712 | A1 | 6/2021 | Gao |
| 2022/0018793 | A1 | 1/2022 | Vestergaard et al. |

FOREIGN PATENT DOCUMENTS

| | | | |
|---|---|---|---|
| CN | 201162853 | Y | 12/2008 |
| CN | 202972015 | U | 6/2013 |
| CN | 103615574 | B | 6/2016 |
| CN | 107883019 | A | 4/2018 |
| CN | 110094568 | A | 8/2019 |
| CN | 211693708 | U | 10/2020 |
| CN | 111946884 | A | 11/2020 |
| CN | 212028701 | U | 11/2020 |
| CN | 112032351 | A | 12/2020 |
| CN | 212389803 | U | 1/2021 |
| CN | 112728159 | A | 4/2021 |
| DE | 10255066 | A1 | 6/2004 |
| EP | 1327810 | A2 | 7/2003 |
| EP | 1331426 | A2 | 7/2003 |
| EP | 1802921 | A2 | 7/2007 |
| EP | 2076940 | A1 | 7/2009 |
| EP | 2171731 | A1 | 4/2010 |
| EP | 2261538 | A1 | 12/2010 |
| EP | 2818779 | A1 | 12/2014 |
| EP | 3098543 | A1 | 11/2016 |
| EP | 3106726 | A1 | 12/2016 |
| EP | 2909514 | B1 | 2/2018 |
| EP | 3499101 | A1 | 6/2019 |
| EP | 3660419 | A1 | 6/2020 |
| EP | 3712434 | A1 | 9/2020 |
| EP | 3942185 | A1 | 1/2022 |
| EP | 4113037 | A1 | 1/2023 |
| EP | 4174403 | A1 | 5/2023 |
| GB | 2190726 | A | 11/1987 |
| GB | 2360023 | A | 9/2001 |
| GB | 2360024 | A | 9/2001 |
| JP | 3614097 | B2 | 1/2005 |
| JP | 5602477 | B2 | 10/2014 |
| JP | 5802350 | B2 | 10/2015 |
| JP | 6329365 | B2 | 5/2018 |
| JP | 6465619 | B2 | 2/2019 |
| JP | 6530991 | B2 | 6/2019 |
| JP | 6556000 | B2 | 8/2019 |
| JP | 6661433 | B2 | 3/2020 |
| WO | 2006028799 | A2 | 3/2006 |
| WO | 2006116998 | A1 | 11/2006 |
| WO | 2006116999 | A1 | 11/2006 |
| WO | 2008040353 | A1 | 4/2008 |
| WO | 2008141647 | A1 | 11/2008 |
| WO | 2009000271 | A1 | 12/2008 |
| WO | 2009010057 | A1 | 1/2009 |
| WO | 2009049625 | A1 | 4/2009 |
| WO | 2009089835 | A1 | 7/2009 |
| WO | 2009138086 | A1 | 11/2009 |
| WO | 2009/152402 | A2 | 12/2009 |
| WO | 2010025726 | A1 | 3/2010 |
| WO | 2010045946 | A1 | 4/2010 |
| WO | 2018109036 | A1 | 6/2018 |
| WO | 2020164865 | A1 | 8/2020 |
| WO | 2020187468 | A1 | 9/2020 |
| WO | 2020/253097 | A1 | 12/2020 |
| WO | 2021037966 | A1 | 3/2021 |
| WO | 2021037970 | A1 | 3/2021 |
| WO | 2022/213762 | A1 | 10/2022 |

* cited by examiner 100
100
1
21
22
2
11
13
12
11
2, 21
202
211
200
26
24
31
33
32
201
KV=520
KV=360
C
D
E
S
80
15
J
Radial seal

FOUR-WAY REVERSING VALVE FOR A HIGH CAPACITY REVERSIBLE HEAT PUMP COMPRESSOR

CROSS-REFERENCE TO RELATED APPLICATIONS

This application is a National Stage application of International Patent Application No. PCT/EP2022/068351, filed on Jul. 1, 2022, which claims priority to European Patent Application No. 21183550.9, filed Jul. 2, 2021, each of which is hereby incorporated by reference in its entirety.

TECHNICAL FIELD

The present invention pertains to a four-way reversing valve for a high capacity reversible heat pump compressor. The valve comprises a housing with four ports, namely a discharge port, a suction port, an evaporator port and a condenser port. It further comprises a conically shaped rotor provided rotatably inside the housing for varying flow paths between the four ports, wherein a large diameter face of the rotor comprises two separated openings, wherein a first opening fluidly connects the large diameter face to a small diameter face of the rotor via a first fluid conduit and a second opening fluidly connects the large diameter face to a radially outer portion of the rotor via a second fluid conduit. The invention also pertains to a set comprising two or more four-way reversing valves.

BACKGROUND

Four-way reversing valves (4WRV) are known to be used in reversible heat pumps. The known architectures typically use differential pressures as an energy source for operating the valve, a small pilot operated solenoid that energizes a piston of the valve and the piston for driving a slider mechanism to change over the positions of the valve.

Most 4WRVs are used in small variable refrigerant flow (VRF) heat pump systems and with e.g. R410A as refrigerant, in combination with scroll compressors, where traces of oil are present in the discharge gas.

Alternative 4WRVs may be used together with oil free compressors, where no oil is present, and where the mechanism of the valve shall remain operational without any oil.

The fluid flows across valves operated with reversible heat pumps may vary considerably with respect to their density, volume flow-rate and direction. One problem arising from these variable conditions is that the valves do not operate efficiently at all possible flow conditions.

Prior art document WO 2021/037970 A1 discloses such a rotatable four-way reversing valve, which is part of a common unit for a refrigerant gas handling system. The common unit comprises an accumulator, a check valve and said reversing valve. The check valve and the reversing valve are arranged together in a first area and the accumulator is arranged in a second area. The reversing valve is connected to an actuator, which rotates the reversing valve for controlling the refrigerant flow across the valve.

SUMMARY

The aim of the present invention is to provide an improved four-way reversing valve which over-comes this problem. This aim is achieved by a four way reversing valve according to claim 1 and a set of corresponding four-way reversing valves according to claim 19. Preferable embodiments are subject of the dependent claims.

According to claim 1, a four-way reversing valve for a high capacity reversible heat pump com-ressor is provided. The valve comprises a housing with four ports, namely a discharge port, a suction port, an evaporator port and a condenser port, a conically shaped rotor provided rotatably inside the housing for varying flow paths between the four ports, wherein a large diameter face of the rotor comprises two separated openings, wherein a first opening fluidly connects the large diameter face to a small diameter face of the rotor via a first fluid conduit and a second opening fluidly connects the large diameter face to a radially outer portion of the rotor via a second fluid conduit. According to the invention, a circular portion of the large diameter face exclusively consists of at least parts of the two separated openings and a wall separating said openings and the first and second openings are bound by at least one circular arc and one or more straight edges.

The two separated openings may be separated only by the wall and may represent a large part or the largest part of the large diameter face. Most of the large diameter face and in particular a central portion of the large diameter face may be occupied by the two separated openings. This yields a rotor which, for a given size, has the greatest possible openings, offering the least flow resistance or greatest Kv flow coefficient through said openings. Rotating the rotor by 180° makes it possible to alternatively connect the two separated openings to two different ports. The term face is understood in a broad sense and does not refer to a uniformly solid portion of the rotor. Rather, it refers to an outer portion of the rotor, which may be planar and/or which may comprise one or more openings.

In a preferred embodiment of the invention, the first and second openings are of the same size and shape and/or the first and second openings are of a semi-circular shape. The exact shape of the openings may be chosen so as to optimize the flow through the openings and the rotor.

In another preferred embodiment of the invention, the dividing wall passes through the center of the large diameter face and/or the circular portion is arranged concentrically to the large diameter face and/or the radius of the circular portion is at least 50%, 66% or 75% of the radius of the large diameter face, in particular the outer radius of the large diameter face.

The centre of the large diameter face may be the centre of rotation of the rotor. As the wall may pass through said centre of rotation of the rotor, the wall or a portion thereof may be used for rotatably connecting the rotor to the housing of the valve. Positioning the circular portion concentrically with respect to the large diameter face makes it possible to maximise the cross-sectional area of the openings provided in the circular portion. The radius of the circular portion may be maximised such that the cross section area of the openings is maximised accordingly. The circular portion may be defined such that it only comprises the openings or parts of the openings and the wall or parts of the wall dividing the openings. The circular portion is not a component in itself, but defines an area of the large diameter face, in which only the openings and the wall are present.

In another preferred embodiment of the invention, the dividing wall stretches along the entire length of the rotor and separates the first fluid conduit from the second fluid conduit and/or the dividing wall has a straight cross section close to the large diameter face and/or a curved cross section close to the small diameter face.

The term fluid conduit may be understood in a broad sense and may refer to long or short passages or openings, through which a fluid may flow during the operation of the valve. The cross section or the shape of the wall may change gradually between the large and small diameter faces.

In another preferred embodiment of the invention, the rotor is supported against the housing by means of a pin provided at the centre of the wall, wherein the pin is preferably surrounded by a glide ring and/or the rotor is dimensioned to balance the pressures occurring at the first fluid conduit and second fluid conduit.

In particular, the surface areas pointing in or viewed from an axial direction of the rotor may be chosen such that different pressures acting on the inside and the outside of the rotor yield no resultant force acting on the rotor. As no resultant force is acting on the rotor, the sealing of the rotor may be subject to constant or near constant stresses, independently of the pressure differences occurring at the rotor. Hence, a leakage of the sealing is less likely to occur. While the rotor may experience no resultant force, a moment may still be exerted on the rotor as a result of a pressure gradient.

In another preferred embodiment of the invention, a radially outer portion of the large diameter face or the small diameter face comprises a gear and/or the large diameter face comprises chamfers at least at some of its interior edges.

The gear may be provided at an outer circumference of the respective portion. The gear may be used for turning the rotor by means of some actuator. The chamfers at the large diameter face may be provided at the wall. The chamfers may facilitate the rotation of the rotor, in particular as the wall may have to move past some sealing component when the rotor is turned.

In a particularly preferred embodiment of the invention, the gear is made of a different material than the remainder of the rotor. While the reminder of the rotor may be made of aluminium or an aluminium alloy, the gear may be made from some steel or other alloy. The gear and the reminder of the rotor may be connected to each other by e.g. screws. The screws may be screwed to the rotor in a direction perpendicular to the large diameter face of the rotor i.e. the axial direction of the rotor.

In another preferred embodiment of the invention, a first seal, in particular a V-lip seal, is provided at or close to the small diameter face and/or an axial glide ring pressed against an O-ring is provided at or close to the large diameter face.

The first seal may be contacting an outer circumference of the rotor or its small diameter face. The axial gliding ring may be contacting an axial side of the rotor, i.e. a side or portion of the rotor, which is perpendicular to the axial direction of the rotor.

In another preferred embodiment of the invention, a spring and/or a bearing are provided at or close to the small diameter face, wherein the spring is provided for exerting a force on the rotor in an axial direction of the rotor.

The spring may exert a force on the rotor via the bearing. The two components may be in close contact with each other. The force exerted on the rotor by the spring may press the rotor against some sealing components provided at or close to the large diameter face of the rotor.

In another preferred embodiment of the invention, a radially outer portion of the large diameter face or the small diameter face comprises a permanent magnet and/or ferromagnetic material.

The magnetic component may be used in combination with a sensor for determining the angular position of the rotor with respect to the remainder of the valve.

In an example of a particularly preferred embodiment of the invention, a sensor, in particular a reed sensor, a hall sensor and/or an inductive sensor, is provided for interacting with the permanent magnet.

The sensor may be provided together with the remainder of the valve and/or may be permanently and/or integrally provided with the valve.

In a preferred embodiment of the invention, a motor, in particular a DC gear motor, is connected to the housing for turning the rotor via the gear. The motor may be at least partially positioned inside the housing or inside a recess of the housing. The motor provides the drive power required for changing the position of the valve, i.e. the rotational position of the rotor. The housing may be provided with an opening for connecting a motor output shaft with the rotor.

In a particularly preferred embodiment of the invention, the sensor is provided close to the motor, such that it is included in a housing of the motor. The housing of the motor may be attached to the housing of the valve and may be a different component than the housing of the valve. As the sensor may be integrated in the housing of the motor, the assembly of the valve is simplified. In particular, it is possible to assemble both, the motor and the sensor at the same time, when attaching the housing of the motor to the housing of the valve.

In a preferred embodiment of the invention, the housing comprises an inlet section and an outlet section, wherein the inlet section and the outlet section are connectable to each other via a first flange and/or connectable to each other in different rotary positions with respect to each other, and/or the housing is made of aluminium or an aluminium alloy.

The two mentioned sections of the housing make it possible to orient the housing and in particular the ports of the housing in different orientations. Hence, the valve may be adapted to different geometries of the heat pump architecture easily.

In a particularly preferred embodiment of the invention, the large diameter face of the rotor is provided at least partially between the inlet section and the outlet section. The inlet section and the outlet section may be dimensioned such that the rotor may be inserted between the two sections in a state in which the sections are not connected to each other. A gap or groove may be provided between the inlet section and the outlet section for accommodating at least parts of the large diameter face of the rotor in a state, in which the two sections are connected to each other. The gap or groove between the two sections may accommodate a bearing and/or other components necessary for providing a rotatable connection between the rotor and the housing.

In another particularly preferred embodiment of the invention, the remainder of the rotor is provided inside the inlet section. The reminder of the rotor comprises portions of the rotor other than the large diameter face and/or may comprise further structures for rotatably connecting the rotor to the housing.

In a preferred embodiment of the invention, the housing comprises a valve section, in particular a ball valve section, that is connectable to the inlet section via a second flange. The presence of the valve section does not alter the number of ports provided at the housing. The suction port may be either provided at the inlet section or, if a valve section is present, at said valve section. The valve section makes it possible to fluidly disconnect the valve from a compressor, such that maintenance can be performed on the compressor.

In a preferred embodiment of the invention, the discharge port and/or the evaporator port are arranged at 90°±20°, in particular ±10° with respect to the suction port. The suction port may be arranged in an axial direction of the valve and leading straight into an inlet port of a compressor connected to the valve. The axial direction of the valve may be parallel to the axis of rotation of the rotor.

The invention is also directed at a set comprising two or more of the presently described four-way reversing valves. The valves are fluidly connected by at least one and in particular exactly three or four manifolds. The ports of the valve may be arranged such that two or more valves can be connected fluidly to each other, to a compressor and/or to some heat exchanger architecture supplied by the compressor with heat transfer fluid. Connecting a multitude of valves in this matter makes it possible to scale the performance of the set of valves for heat exchanger architectures of different capacities. It is possible to simply add a required number of identical valves for increasing the capacity of the combined valves, such that it matches a given heat exchanger architecture.

In a preferred embodiment of the invention, at least two identical manifolds are provided. As the ports of the valve may be designed identically to each other, it is possible to use identical manifolds for connecting the individual ports of the valve. This further simplifies the design of a set combining a number of the presently described valves.

BRIEF DESCRIPTION OF THE DRAWINGS

Further advantages and details of the invention are described with reference to the figures. The figures show.

DETAILED DESCRIPTION

Figure 1:
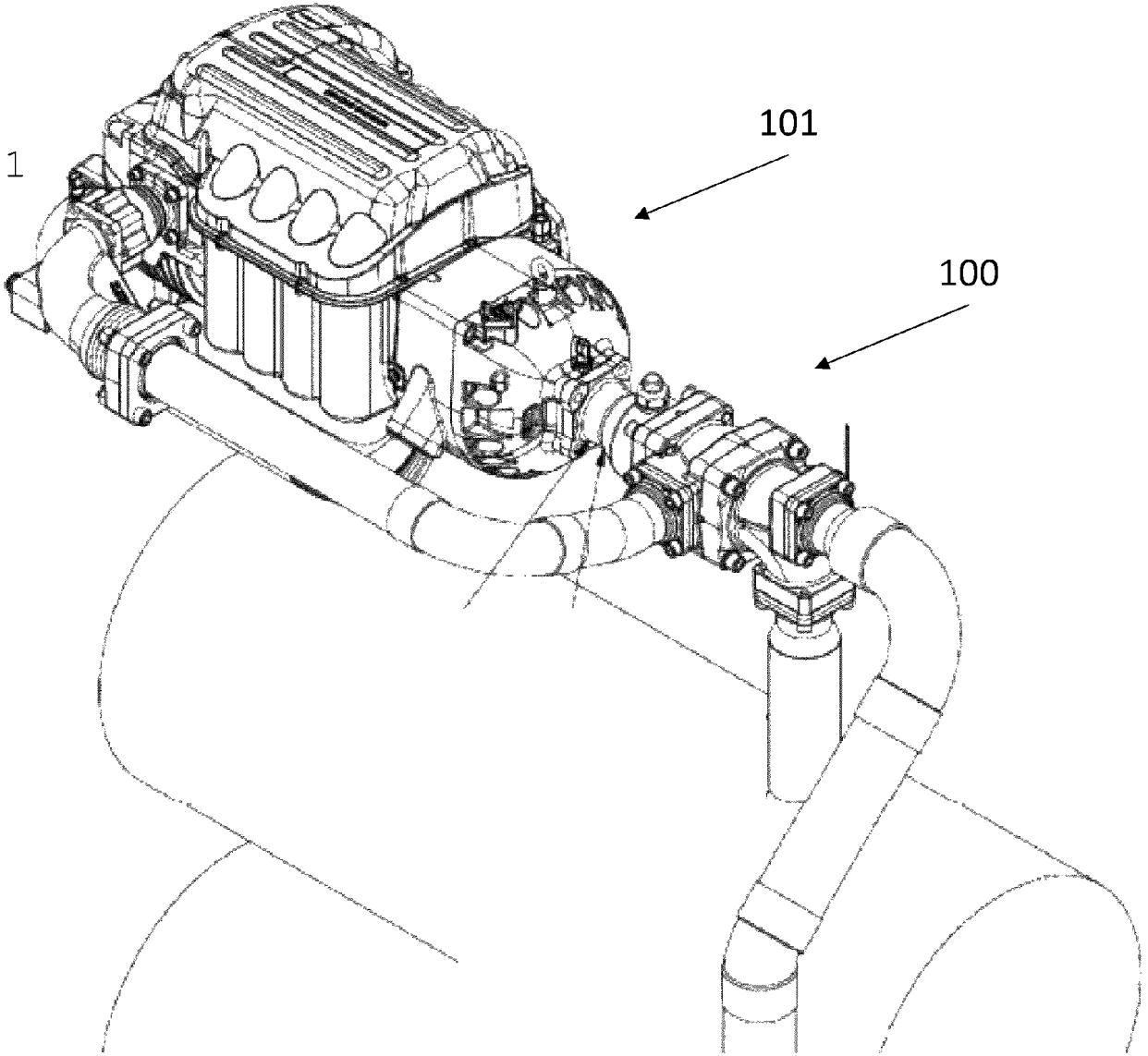
FIG. 1: general overview of a valve and compressor assembly of a reversible heat pump.

FIG. 1 shows a general overview of a four-way reversing valve 100 and compressor 101 assembly of a reversible heat pump. The compressor may be a centrifugal compressor, screw compressor, scroll compressor or some other compressor. The structure of the reversible heat pump is only shown in part and is symbolised by the two large diameter pipes hinted at in the bottom part of the figure. The valve 100 is fluidly connected to the compressor 101 via two fluid conduits and to the remainder of the heat pump via two further fluid conduits. The 90° downward bent port of the valve 100 facing down to the upper pipe avoids installation effort and materials for extra elbows and flanges.

Figures 2A, 2B, 2C:
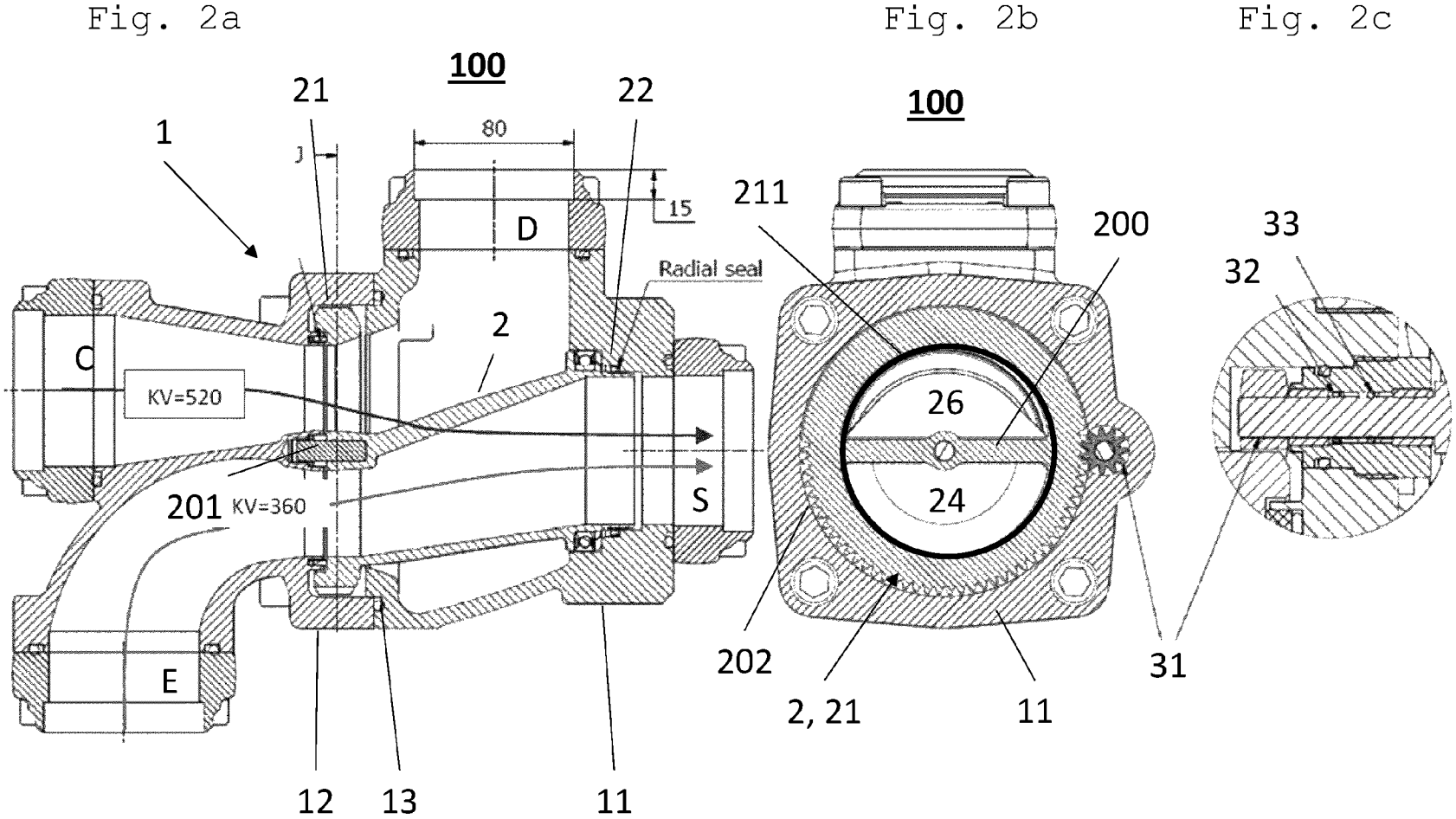
FIG. 2*a*: longitudinal view of the valve.
FIG. 2*b*: cross-sectional view of the valve.
FIG. 2*c*: detailed view of the connection between the rotor and the motor of the valve.

FIG. 2*a* is a longitudinal view of the four-way reversing valve 100. The valve 100 is provided for the previously shown high capacity reversible heat pump compressor 101. The valve 100 comprises a housing 1 with four ports D, S, E, C, namely a discharge port D, a suction port S connectable to the compressor 101, an evaporator port E and a condenser port C.

Inside the housing 1, a conically shaped rotor 2 is provided for varying and/or changing flow paths between the four ports D, S, E, C. The rotor 2 may alter the flow paths by rotating with respect to the housing 1 around an axis of rotation of the rotor 2. The axis of rotation of the rotor 2 is horizontal in FIG. 2*a*. In the position of the rotor 2 shown in FIG. 2*a*, the evaporator port E is connected to the suction port S and the discharge port D is connected to the condenser port C.

The housing 1 comprises an inlet section 11 and an outlet section 12, connected to each other via a first flange 13. These sections 11, 12 may be connected to each other in different rotary positions with respect to each other. The housing 1 may be made of aluminium or an aluminium alloy.

The two mentioned sections 11, 12 of the housing 1 make it possible to arrange the housing 1 and in particular the ports D, S, E, C of the housing 1 in different orientations. In the embodiment of FIG. 2*a*, the discharge port D points in the opposite direction of the evaporator port E. However, the inlet section 11 may be rotated with respect to the outlet section 12 that the discharge port D points in the same direction as the evaporator port E, i.e. in a direction vertically downwards in FIG. 2*a*. Alternatively, the discharge port D may be oriented such that it is perpendicular to the drawing plane and points into or out of the drawing plane. Hence, the valve 100 may be adapted to different geometries of the heat pump architecture easily.

FIG. 2*b* shows a cross-sectional view of the valve 100 with a large diameter face 21 of the rotor 2 pointing out of the drawing plane. The rotor 2 is shown inside the inlet section 11. The rotor 2 may be arranged mainly in the inlet section 11, however, a small portion of it may be arranged in the outlet section 12 in an assembled state of the valve 100. A radially outer portion of the large diameter face 21 comprises a gear 202 for meshing with a cogwheel 31 or any other suitable gear. The cogwheel 31 is driven by a motor 3, which will be shown in more detail in further figures. A circular portion 211 of the large diameter face 21 exclusively consists of the separated openings 24, 26 and a wall 200 separating said openings 24, 26. In an alternative embodiment, the gear 202 may be provided at the small diameter face 22 of the rotor 2. The gear 202 may be provided at an outer circumference of the respective component.

The gear 202 may be made of a different material than the remainder of the rotor 2. While the reminder of the rotor 2 may be made of aluminium or an aluminium alloy, the gear 202 may be made from some steel or other alloy. The gear 202 and the reminder of the rotor 2 may be connected to each other by e.g. screws. The screws may be screwed to the rotor 2 in a direction perpendicular to the large diameter face 21 of the rotor 2 i.e. the axial direction of the rotor 2.

FIG. 2*c* is a detailed view of the connection between the rotor 2 and the motor 3 of the valve 100. A lip seal 32 and an O-ring 33 may be provided between the cogwheel 31 and the motor 3.

Figure 3B:
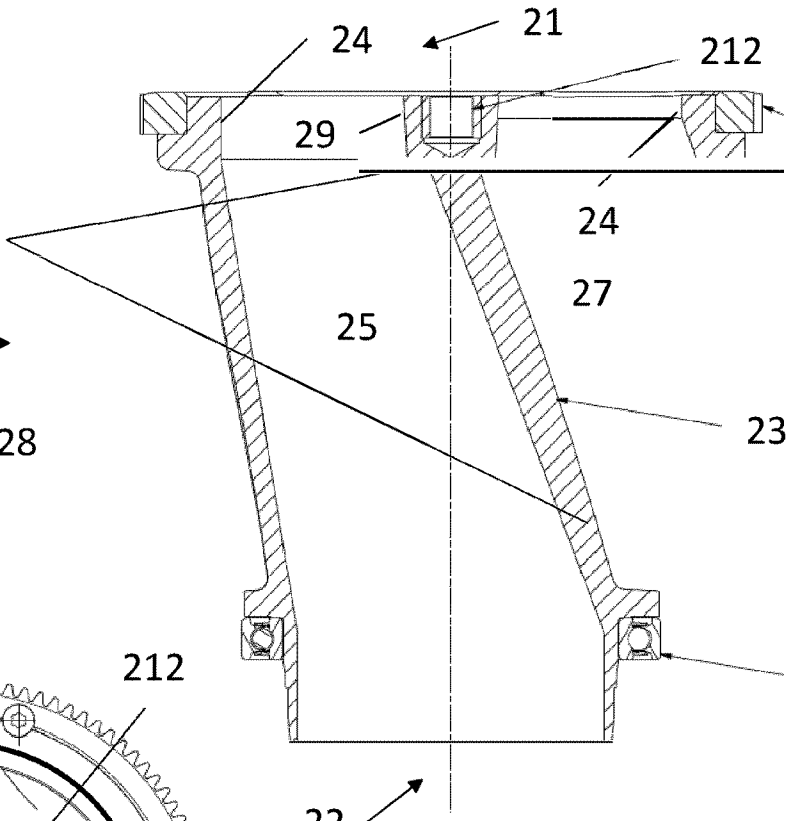
FIG. 3*b*: longitudinal view of the rotor.
Figure 3C:
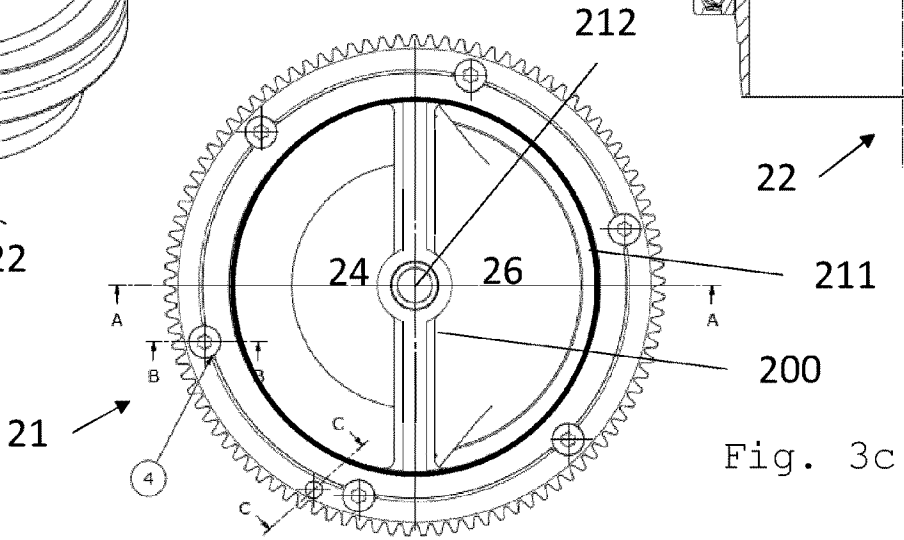
FIG. 3*c*: plan view of the rotor
Figure 3A:
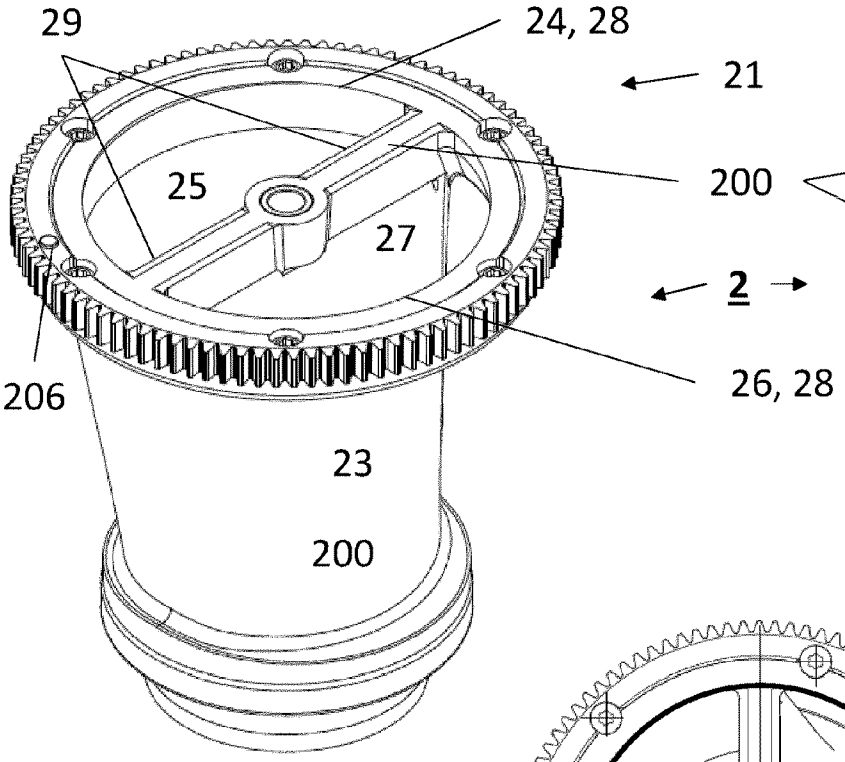
FIG. 3*a*: perspective view of the rotor.

FIG. 3*a* is perspective view of the rotor 2. The rotor 2 comprises two separated openings 24, 26, wherein a first opening 24 fluidly connects the large diameter face 21 to a small diameter face 22 of the rotor 2 via a first fluid conduit 25 and a second opening 26 fluidly connects the large diameter face 21 to a radially outer portion 23 of the rotor 2 via a second fluid conduit 27.

The two separated openings 24, 26 may be separated only by the wall 200 and may represent a large part or the largest part of the large diameter face 21. Most of the large diameter face 21 and in particular a central portion of the large diameter face 21 may be occupied by the two separated openings 24, 26. This yields a rotor 2 which, for a given size, has the greatest possible openings 24, 26, offering the least flow resistance or greatest flow coefficient Kv through said openings 24, 26. Rotating the rotor 2 by 180° makes it possible to alternatively connect the two seperated openings 24, 26 to two different ports. The term face is understood in a broad sense and does not refer to a uniformly solid portion of the rotor 2. Rather, it refers to an outer portion of the rotor 2, which may be planar and/or which may comprise one or more openings.

In the embodiment of FIG. 3*a*, the first and second openings 24, 26 are of the same size and shape. Both openings 24, 26 are bound by at least one circular arc 28 and one or more straight edges 29. The first and second openings 24, 26 may be of a semi-circular shape. The exact shape of the openings 24, 26 may be chosen so as to optimize the flow through the openings 24, 26 and the rotor 2.

The large diameter face 21 may comprise chamfers at least at some of its interior edges, in particular the straight edges 29. Hence, the chamfers at the large diameter face 21 may be provided at the wall 200. The chamfers may facilitate the rotation of the rotor 2, in particular as the wall 200 may have to move past some sealing component when the rotor 2 is turned.

FIGS. 3*a* to 3*c* show that the dividing wall 200 passes through the centre of the large diameter face 21 and/or the circular portion 211 is arranged concentrically to the large diameter face 21 and/or the radius of the circular portion 211 is at least 50%, 66% or 75% of the radius of the large diameter face 21, in particular the outer radius of the large diameter face 21.

The centre of the large diameter face 21 may be the centre of rotation of the rotor 2. As the wall 200 may pass through said centre of rotation of the rotor 2, the wall 200 or a portion thereof may be used for rotatably connecting the rotor 2 to the housing 1 of the valve 100. Positioning the circular portion 211 concentrically with respect to the large diameter face 21 makes it possible to maximise the cross-sectional area of the openings 24, 26 provided in the circular portion 211. The radius of the circular portion 211 may be maximised such that the cross section area of the openings 24, 26 is maximised correspondingly. The circular portion 211 may be defined such that it only comprises the openings 24, 26 or parts of the openings 24, 26 and the wall 200 or parts of the wall 200 dividing the openings 24, 26. The wall 200 may be understood to comprise a central support 212 for supporting the rotor 2 against the housing 1. The circular portion 211 is not a component in itself, but defines an area of the large diameter face 21, in which only the two openings 24, 26 and the wall 200 are present.

FIG. 3*b* shows that the dividing wall 200 stretches along the entire length or almost the entire length of the rotor 2 and separates the first fluid conduit 25 from the second fluid conduit 27. According to FIGS. 3*a* and 3*c*, the dividing wall 200 has a straight cross section close to the large diameter face 21. Close to the small diameter face 22, the wall 200 may have a curved cross section, as indicated in FIG. 3*a*. A radially outward portion of the wall 200 may form the radially outward portion 23 of the rotor 2.

The term fluid conduit may be understood in a broad sense and may refer to long or short passages or openings, through which a fluid may flow during the operation of the valve 100. The cross section or the shape of the wall 200 may change gradually between the large diameter face 21 and the small diameter face 22.

The rotor 2 is shaped conically in the sense that the large diameter face 21 and the small diameter face 22 are arranged concentrically to each other and that the central portion between the large diameter face 21 and the small diameter face 22 at least partially and gradually changes its cross-sectional area and shape from approximately the small diameter face's 22 area and shape to at least partially the large diameter face's 21 area and shape.

Figure 4B:
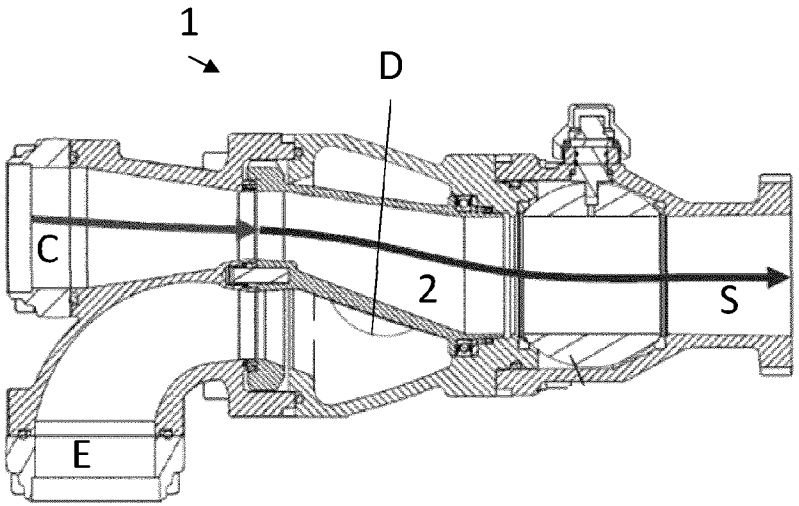
FIGS. 4*a*, 4*b*: longitudinal views of the valve in two different position.
Figure 4A:
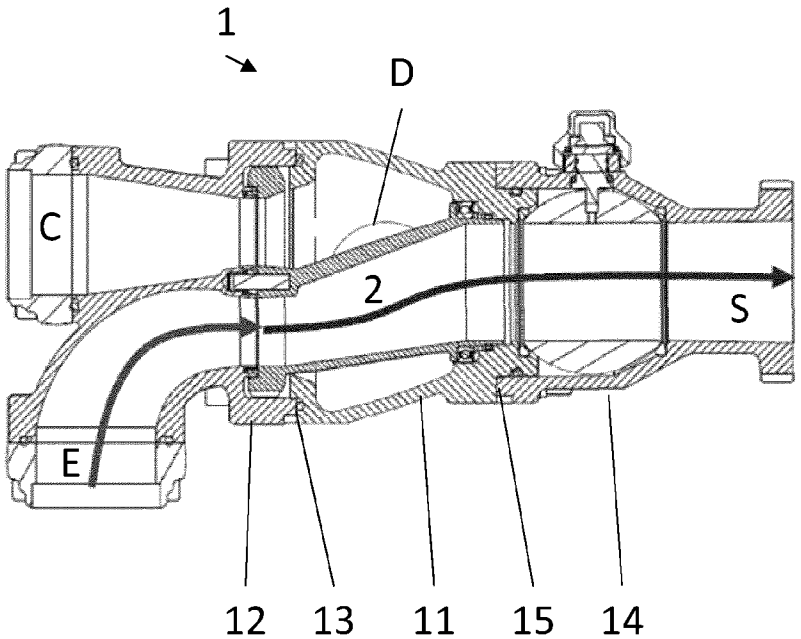

FIGS. 4*a* and 4*b* show the valve 100 in two different position. In FIG. 4*a*, the rotor 2 is rotated such the evaporator port E is connected to the suction port S. In FIG. 4*b*, the rotor 2 is rotated such the condenser port C is connected to the suction port S.

The flow of a suction gas is indicated by two arrows in each figure. As the density of suction gas at the suction port S may be about 6 times smaller than in the discharge line connected to the discharge port D, the gas speed may be 6 times larger at the suction port S for the same mass flow rate. This means that the Kv towards the suction port S should be maximized to avoid too much energy loss. To maximize Kv in the suction sections of the 4WRV, the cross sections are-as in the valve 100 are designed to change steadily from e.g. Ø75 diameter to Ø68 to Ø76 at the suction port S of the compressor 101 to recover most of the dynamic pressure back into static pressure. In the FIGS. 4*a*, 4*b*, the left arrow indicates the valve 100 section where fluid accelerates and the right arrow where the fluid decelerates.

Additionally to the inlet section 11 and the outlet section 12, the embodiment of FIG. 4*a* comprises a valve section 14, in particular a ball valve section, that is connectable to the inlet section 11 via a second flange 15.

The presence of the valve section 14 does not alter the number of ports provided at the housing 1. The suction port S may be either provided at the inlet section 11 or, if a valve section 14 is present, at said valve section 14. The valve section 14 makes it possible to fluidly disconnect the valve 100 from a compressor 101, such that maintenance can be performed on the compressor 101.

The discharge port D and the evaporator port E are arranged at an angle of 90°±20°, in particular ±10° with respect to the suction port S. The suction port S may be arranged in an axial direction of the valve 100 and leading straight into an inlet port of a compressor 101 connected to the valve 100. The axial direction of the valve 100 may be parallel to the axis of rotation of the rotor 2.

FIGS. 5*a* to 5*d* show different orientations of the inlet section 11 to the outlet section 12. The discharge port D is part of the inlet section 11 and the orientation of the discharge port D depends on the orientation of the inlet section 11. The inlet section 11 and the outlet section 12 may be connectable in four distinct orientations with respect to each other.

Figure 5A:
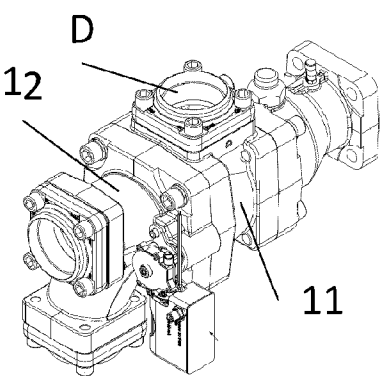
FIGS. 5*a*-5*d*: different orientations of the inlet section to the outlet section.
Figure 5B:
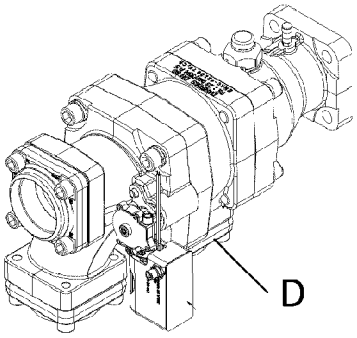
Figure 5C:
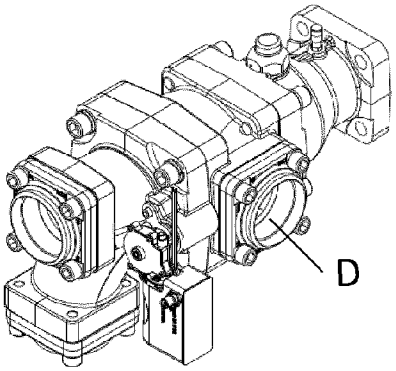
Figure 5D:
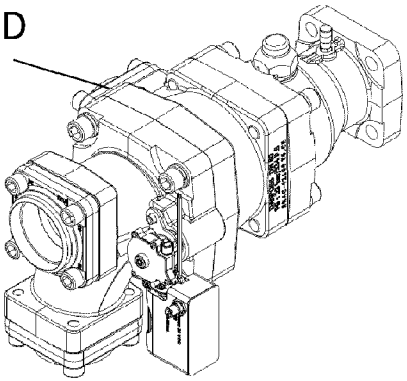
Figure 5E:
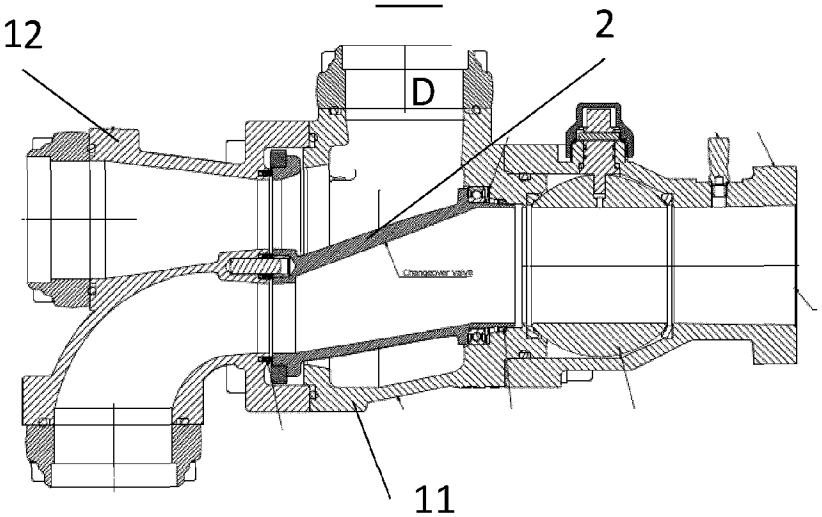
FIGS. 5*e*, 5*f* internal arrangement of the rotor in one orientation of the inlet section.
Figure 5F:
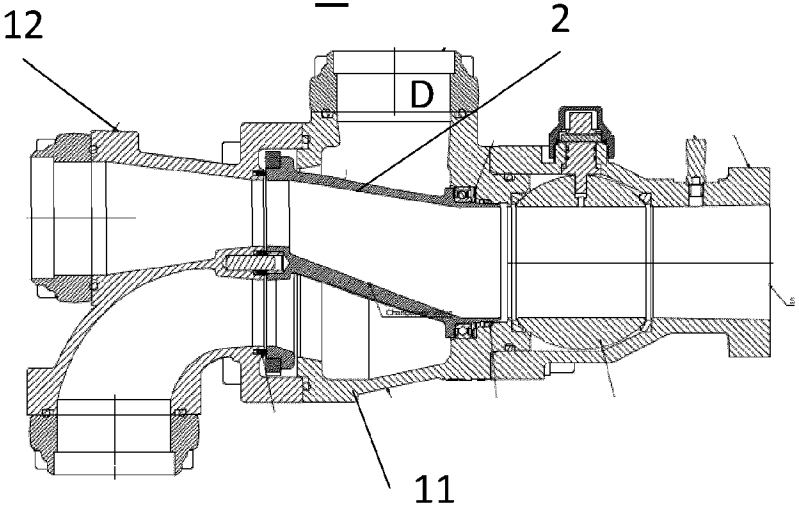

FIGS. 5*e* and 5*f* show the internal arrangement of the rotor 2 inside the valve 100. The valve 100 is shown in a configuration, in which the discharge port D points upwards, as in FIG. 5*a*.

Figure 6A:
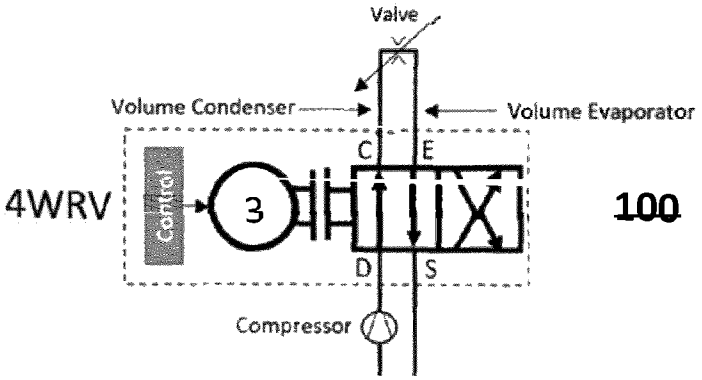
FIG. 6*a*: circuit diagram of a part of the heat pump system.

FIG. 6*a* is a circuit diagram of the 4WRV valve 100. The four port C, E, D, S may be connected to each other in two alternative ways. The motor 3 turns the previously described rotor 2 such that the condenser, the evaporator, and the compressor of the heat pump are connected in the desired way. The motor 3 may be controlled by some external or internal controller. The discharge port D may always be connected to the compressor 101 outlet port and the suction port S to the compressor 101 inlet port.

Figure 6B:
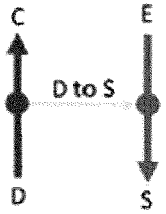
FIG. 6*b*: schematics of bypass function.

FIG. 6*b* is a schematics presentation of a bypass function of the valve 100. The four ports C, E, D, S may be connected such that a bypass is provided between the discharge port D and the suction port S.

Figure 6C:
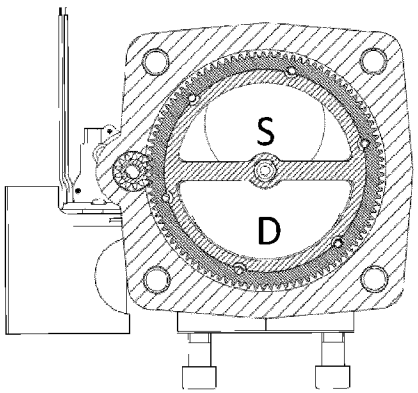
FIGS. 6*c*-6*f*: bypass and non-bypass positions of the rotor.
Figure 6D:
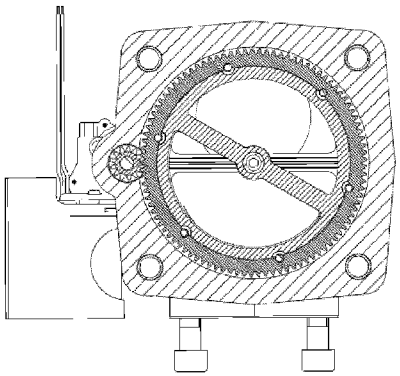
Figure 6E:
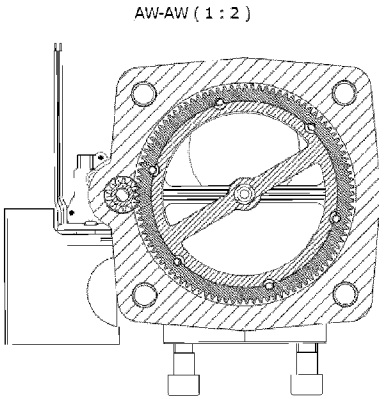
Figure 6F:
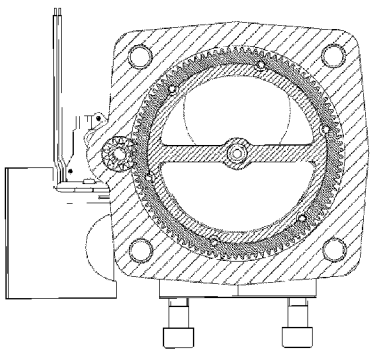

FIGS. 6*c* to 6*f* show the physical orientation of the rotor 2 for providing bypassed and non-bypassed settings of the valve 100. In FIG. 6*c*, the rotor 2 is set at 0° and no bypass is provided between the discharge port D and the suction port S. At a 45° position shown in FIG. 6*d*, a bypass is provided between the discharge port D and the suction port S. The bypass is still present at the 135° positions shown in FIG. 6*e*. No bypass is shown at the inverted position of the rotor 2 at 180°. During changeover from the position shown in FIG. 6*c* to the position shown in FIG. 6*e*, the valve 100 connects all ports C, E, D, S. The bypassing positions may be advantageous during the start-up of the compressor 101, as they effectively reduce the load on the compressor 101. Furthermore, the bypassing positions may also be used in situations, in which only minimal performances of the heat pump are required. The bypassing positions effectively reduce the efficiency of the valve 100, which may be useful in situations, in which less heat pump performance is required, than a lowest setting of the compressor 101 can deliver.

Figure 7:
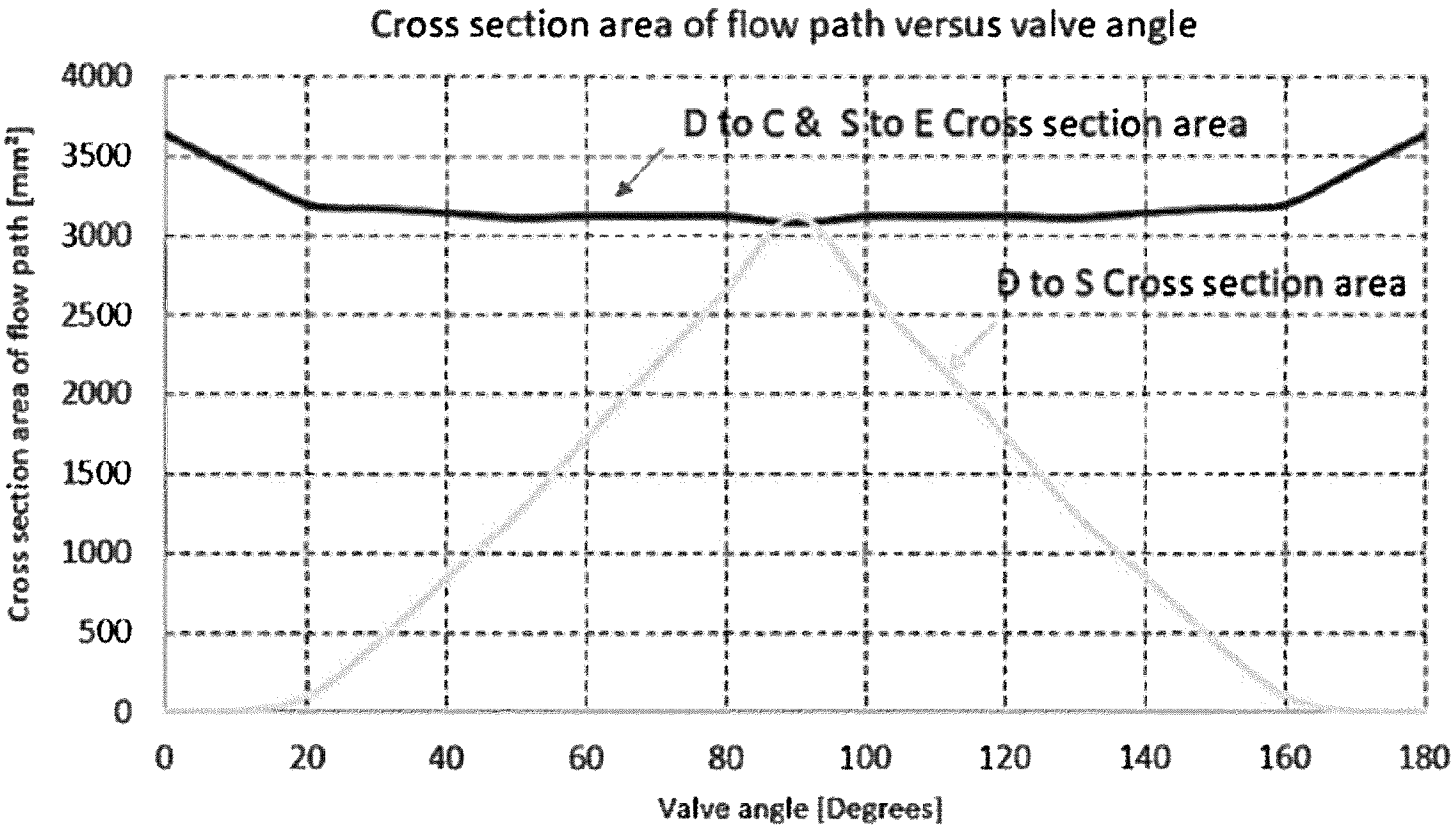
FIG. 7: graphs illustrating areas between the ports D, S, E, C as function of rotor angle.

The bottom line in FIG. 7 illustrates the corresponding increase and decrease in area between the discharge port D and the suction port S during the rotation of the rotor 2 indicated in FIGS. 6*c* to 6*f*.

Figure 8:
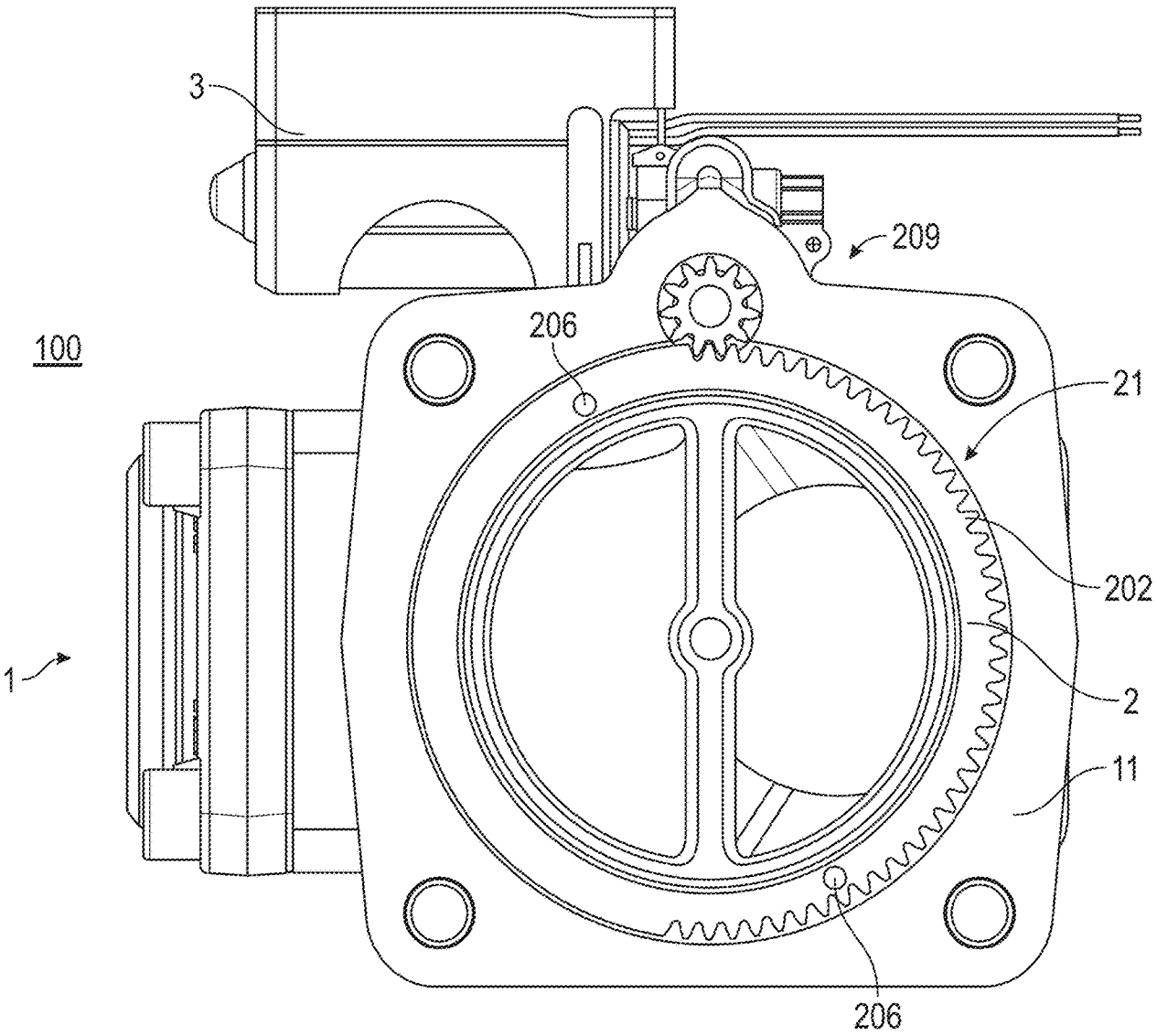
FIG. 8: details on the arrangement of the motor with respect to the housing.

FIG. 8 shows more details on the arrangement of the motor 3 with respect to parts of the housing 1. The rotor 2 is attached to the inlet section 11 and coupled to the rotor 2 via cogwheel 31 and gear 202. The gear 202 may extend over 180° or 360° of the circumference of the rotor 2.

A radially outer portion of the large diameter face 21 of the rotor 2 comprises at least one permanent magnet 206 and/or some ferromagnetic material. The magnetic component may be used in combination with a sensor 209 for determining the angular position of the rotor 2 with respect to the remainder of the valve 100.

The objective of the valve sensor 209 is to provide positional feedback when the valve 100 has fully turned the rotor 2. The sensor 209 may be of a reed type that includes a mechanical contact that closes when subjected to a magnetic field. The valve 100 cooling and heating position may be detected by two permanent magnets 206 in the moving rotor 2, each 180° apart from another. To ensure the magnetic field of the magnet 206 is strong enough to penetrate the solid aluminium wall of the valve 100 and reach the sensor 209, no metal parts affecting the magnetic field are arranged close to the field. The position of the magnet 206 is chosen so it is in closer proximity of the motor 3 to be able to include the sensor 209 in the actuator housing.

The sensor 209 may be a reed sensor, a hall sensor and/or an inductive sensor. The sensor 209 may be provided for interacting with the permanent magnet 206. The sensor 209 may be provided together with the remainder of the valve 100 and/or may be permanently and/or integrally provided with the valve 100.

The sensor 209 may be provided close to the motor 3, such that it is included in a housing of the motor 3. The housing of the motor 3 may be attached to the housing 1 of the valve 100. As the sensor may be integrated in the housing of the motor 3, the assembly of the valve 100 is simplified. In particular, it is possible to assemble both, the motor 3 and the sensor 209 at the same time, when attaching the housing of the motor 3 to the housing 1 of the valve 100.

The motor 3 may be at least partially positioned inside the housing 1 or inside a recess of the housing 1 of the valve 100. The motor 3 provides the drive power required for changing the position of the valve 100, i.e. the rotational position of the rotor 2. The housing 1 may be provided with an opening for connecting a motor 3 output shaft with the rotor 2.

Figure 9:
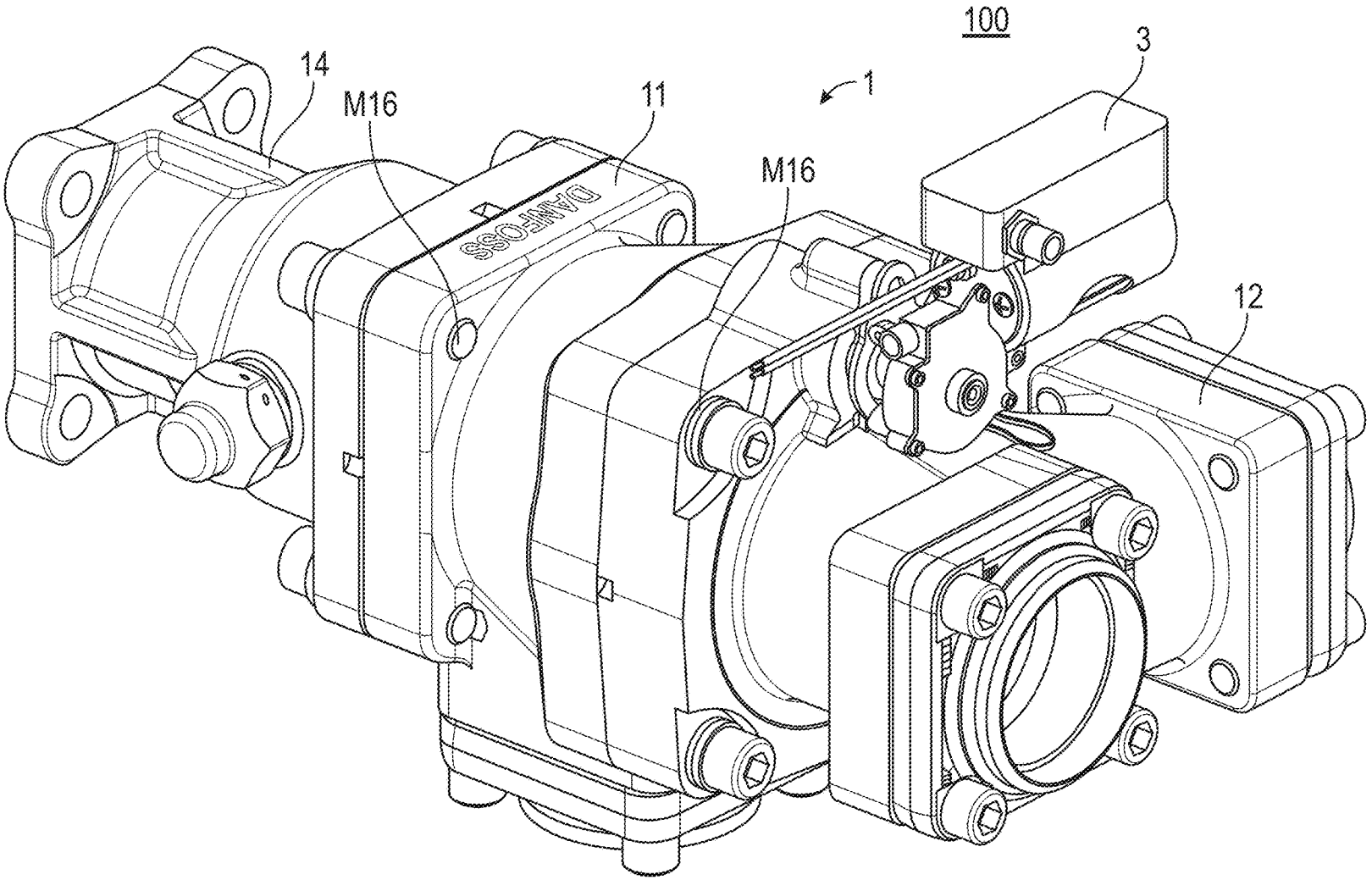
FIG. 9: general overview of the assembled valve.

FIG. 9 is a general overview of the assembled valve 100. The motor 3 for turning the hidden rotor 2 is connected to the housing 1 and the valve 100 is ready for being connected to a compressor 101 and to the piping of a heat pump arrangement. The housing 1 comprises an inlet section 11, an outlet section 12 and a valve section 14.

Figure 10:
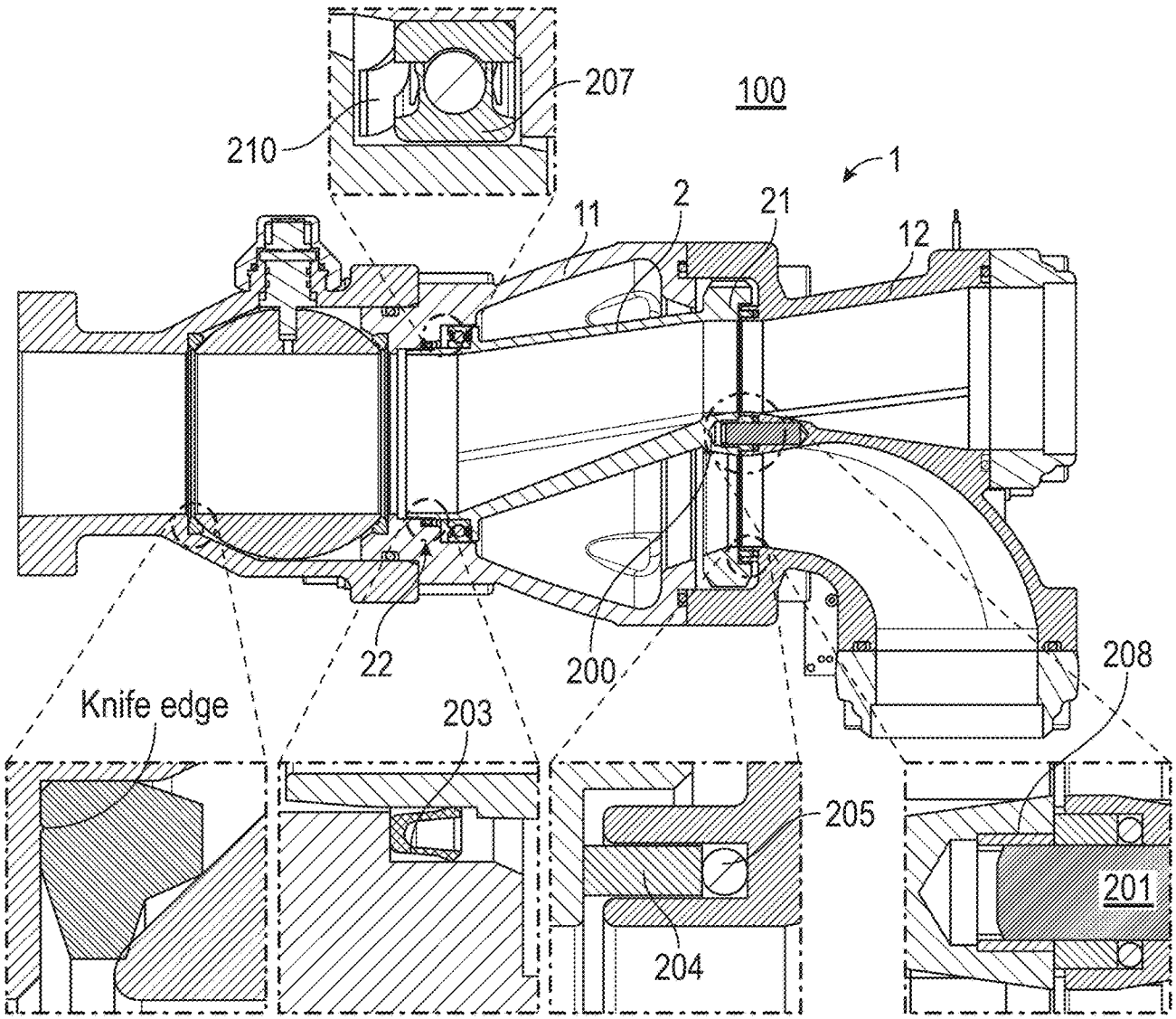
FIG. 10: longitudinal section view of the valve.

FIG. 10 is a longitudinal section view of the valve 100. Above and below the main image, detailed enlarged views of the main image are provided. The large diameter face 21 of the rotor 2 is provided at least partially between the inlet section 11 and the outlet section 12. In particular, a radially most external portion of the large diameter face 21 may face a portion of the outlet section 12 on one side and the inlet section 11 on an opposite side.

The inlet section 11 and the outlet section 12 may be dimensioned such that the rotor 2 may be inserted between the two sections 11, 12 in a state in which the sections 11, 12 are not connected to each other. A gap or groove may be provided between the inlet section 11 and the outlet section 12 for accommodating at least parts of the large diameter face 21 of the rotor 2 in a state, in which the two sections 11, 12 are connected to each other. The gap or groove between the two sections 11, 12 may accommodate a bearing and/or other components necessary for providing a rotatable connection between the rotor 2 and the housing 1.

Except for the large diameter face 21, the remainder of the rotor 2 is provided inside the inlet section 11. The reminder of the rotor 2 comprises portions of the rotor 2 other than the large diameter face 21 and/or may comprise further structures for rotatably connecting the rotor 2 to the housing 1.

The rotor 2 is supported against the housing 1 by means of a pin 201 provided at the centre of the wall 200. The pin 201 is surrounded by a glide ring 208.

A first seal 203, in particular a V-lip seal, is provided at or close to the small diameter face 22. An axial glide ring 204 pressed against an O-ring 205 is provided at or close to the large diameter face 21.

The first seal 203 may be contacting an outer circumference of the rotor 2 or its small diameter face 22. The axial gliding ring 204 may be contacting an axial side of the rotor 2, i.e. a side or portion of the rotor 2, which is perpendicular to the axial direction of the rotor 2.

A spring 210 and/or a bearing 207 are provided at or close to the small diameter face 22. The spring 210 is provided for exerting a force on the rotor 2 in an axial direction of the rotor 2. The spring presses the rotor 2 against the axial glide ring 204 and the O-ring 205.

The spring 210 may exert a force on the rotor 2 via the bearing 207. The spring 210 and the bearing 207 may be in close contact with each other. The force exerted on the rotor 2 by the spring 210 may press the rotor 2 against some other sealing components provided at or close to the large diameter face 21 and/or against the pin 201 and/or the glide ring 208 of the rotor 2.

Figure 11:
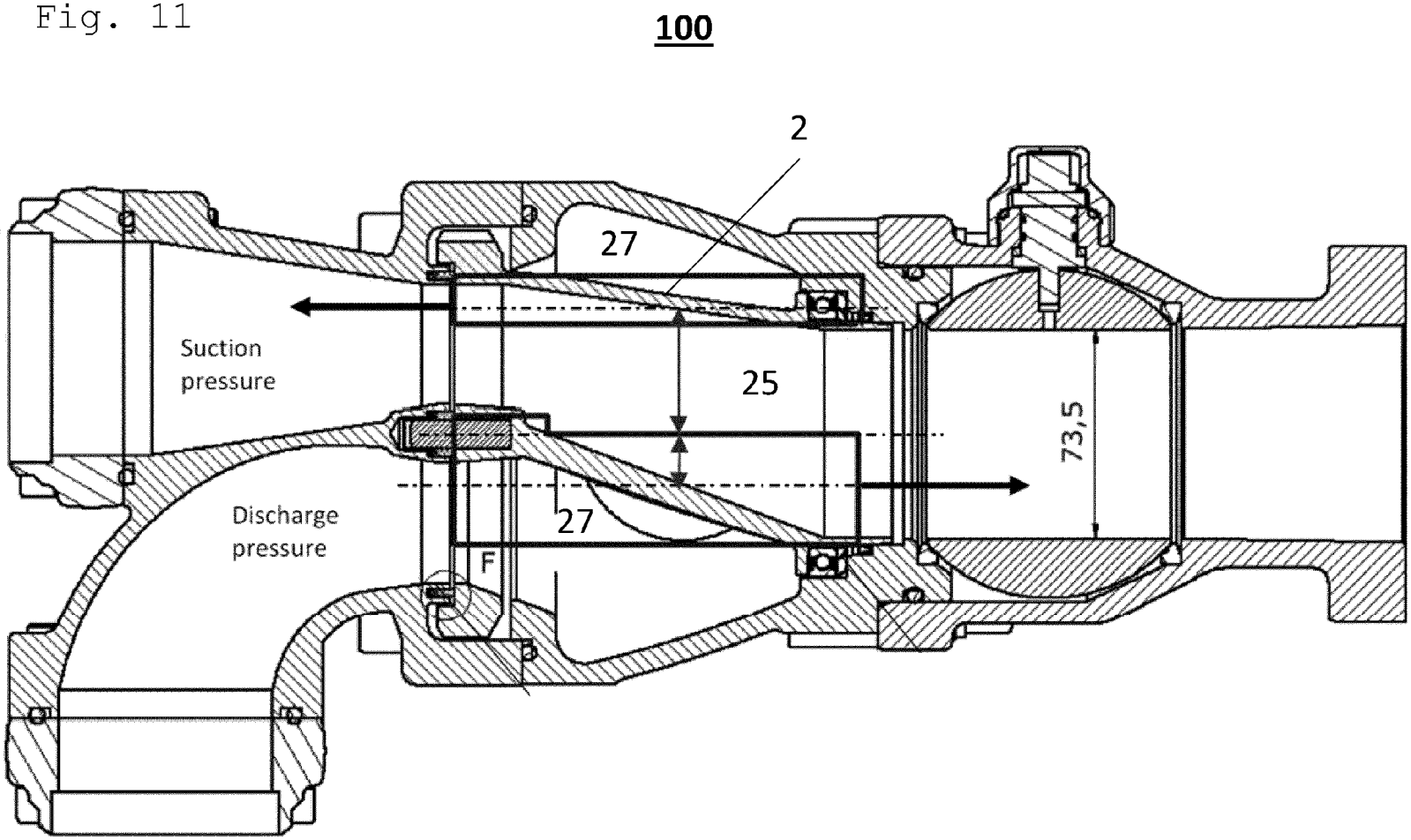
FIG. 11: longitudinal section view of the valve illustrating force distribution.

FIG. 11 is a longitudinal section view of the valve 100 illustrating the pressure distribution in the valve 10. As the suction pressure and the discharge pressure usually differ by some considerable amount, a net force may result from the pressure difference, which acts on the rotor 2.

The valve 100 must deal with the pressure differentials between suction and discharge sections during the rotation of the rotor 2. To minimize the effect of differential pressure on the drive and transmission, a pressure balancing principle is implemented to cancel out any resulting force acting on the rotor 2. However, the pressure balancing areas are out of centre, meaning that there is a moment that produces a side force, which is absorbed by the two radial bearings on either side of the rotor 2 to keep it in centre. The black frames around the sloped rotor 2 walls illustrate how the balancing areas are placed out of centre. The rotor 2 is dimensioned and shaped to balance the pressures occurring at the first fluid conduit 25 and second fluid conduit 27.

In particular, the surface areas pointing in or viewed from an axial direction of the rotor 2 may be chosen such that different pressures acting on the inside and the outside of the rotor 2 yield no resultant force acting on the rotor 2 in the axial direction of the rotor 2. As no resultant force is acting on the rotor 2, the sealing of the rotor 2 may be subject to constant or near constant stresses, independently of the pressure differences occurring at the rotor 2. Hence, a leakage of the sealing is less likely to occur. While the rotor may experience no resultant force, a moment may still be exerted on the rotor as a result of a pressure gradient.

Figure 12:
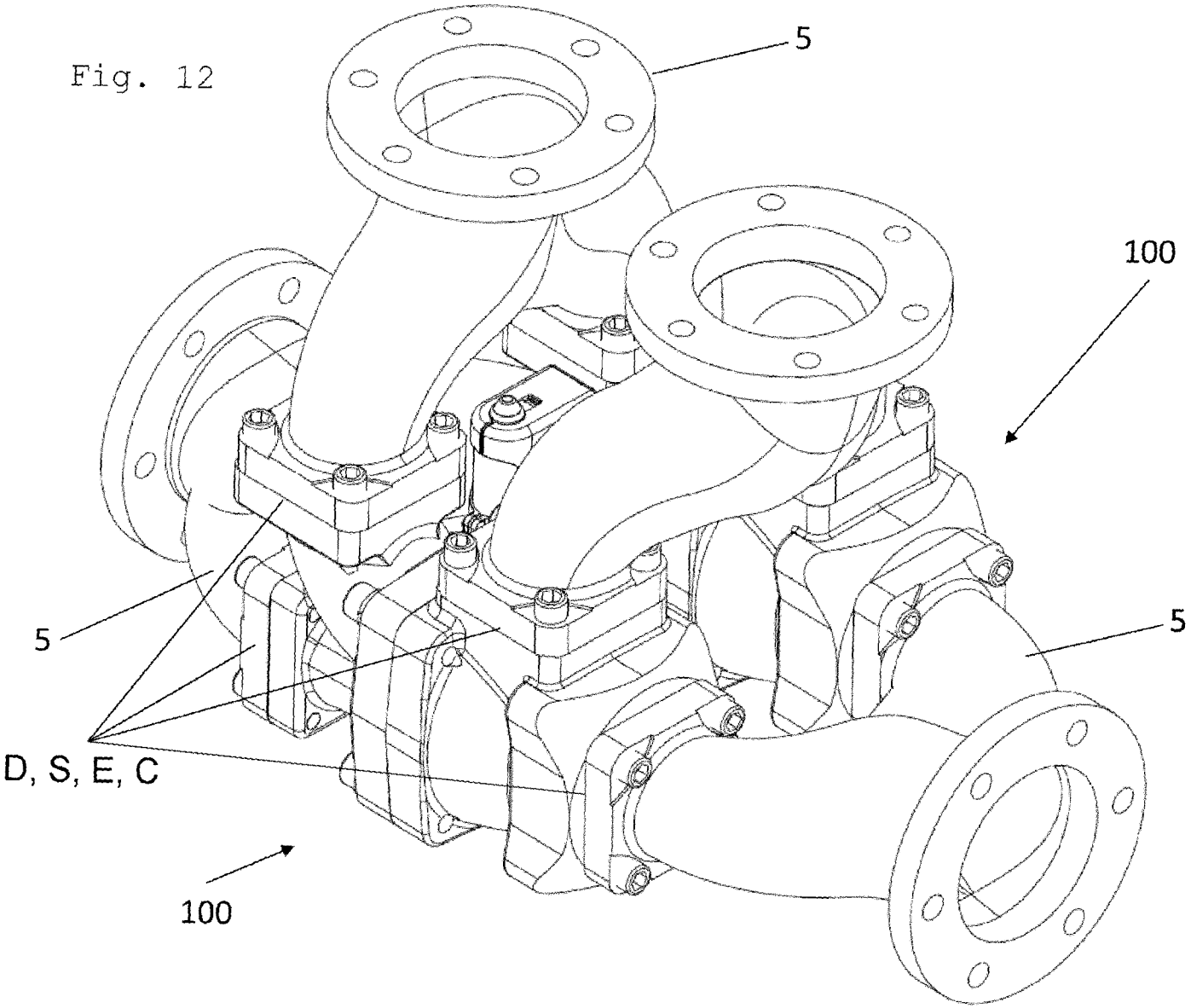
FIG. 12: set of two valves.
Figure 13:
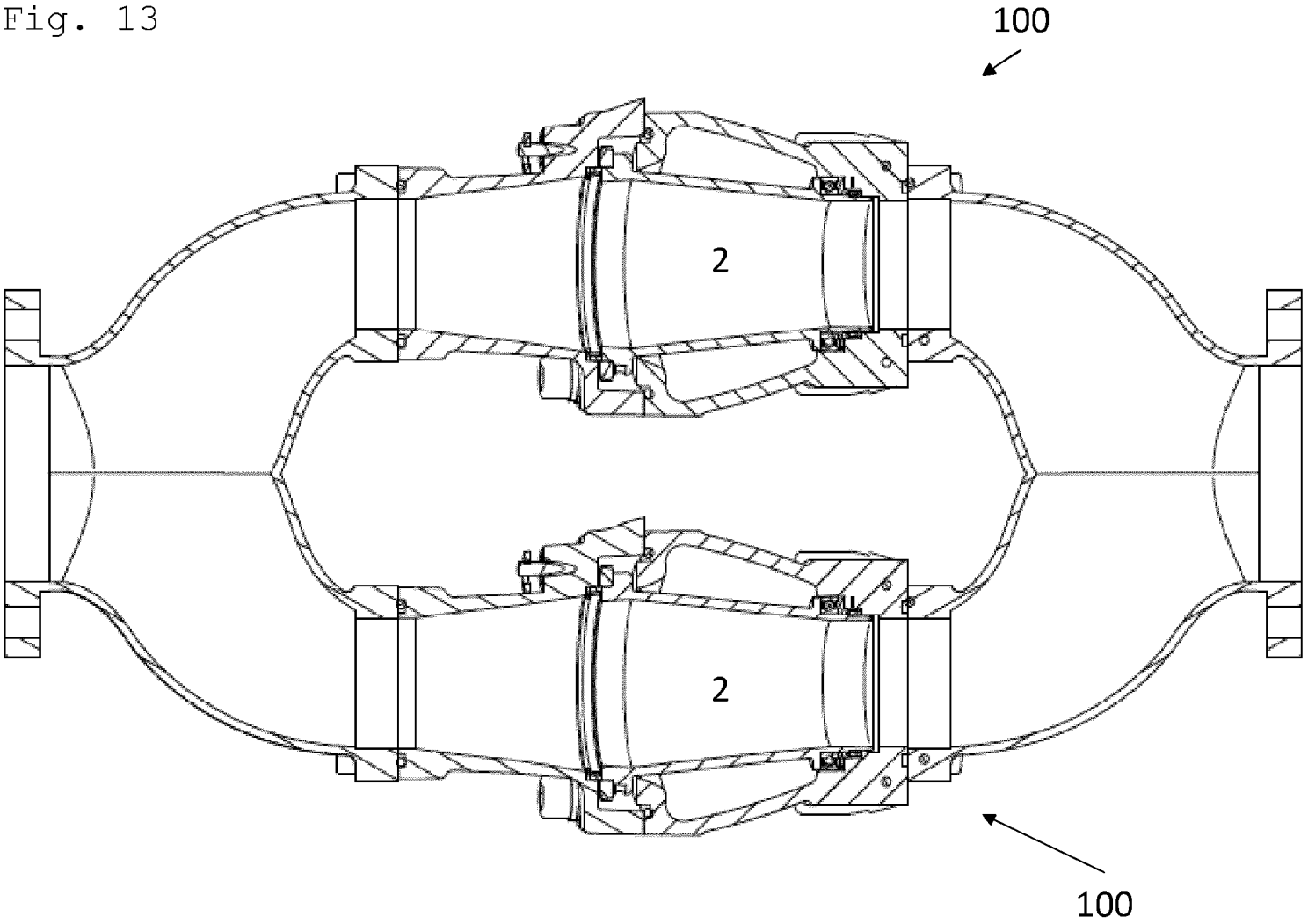
FIG. 13: longitudinal section view of a set of two valves.

FIG. 12 shows a set comprising two four-way reversing valves 100. The valves are fluidly connected by four manifolds 5 to each other and to further components of a heat pump, which are not shown in the figure. As the ports D, S, E, C of the valve 100 may be designed identically to each other, it is possible to use identical manifolds 5 for connecting the individual ports D, S, E, C of the valve 100. This further simplifies the design of a set combining a number of the presently described valves 100. The ports D, S, E, C of the valve 100 may be arranged such that two or more valves 100 can be connected fluidly to each other, to a compressor 101 and/or to some heat exchanger architecture supplied by the compressor with heat transfer fluid. Connecting a multitude of valves 100 in this matter makes it possible to scale the performance of the set of valves 100 for heat exchanger architectures of different capacities. It is possible to simply add a required number of identical valves 100 for increasing the capacity of the combined valves 100, such that it matches a given heat exchanger architecture. FIG. 13 is a longitudinal section view of a set of two valves 100. The geometry of the rotor 2 ensures that the pressure drop across the valve 100 is minimized.

While the present disclosure has been illustrated and described with respect to a particular embodiment thereof, it should be appreciated by those of ordinary skill in the art that various modifications to this disclosure may be made without departing from the spirit and scope of the present disclosure.

The invention claimed is:

1. A four-way reversing valve for a high capacity reversible heat pump compressor, comprising a housing with four ports, namely a discharge port, a suction port, an evaporator port and a condenser port, a conically shaped rotor provided rotatably inside the housing for varying flow paths between the four ports, wherein a large diameter face of the rotor comprises two separated openings, wherein a first opening fluidly connects the large diameter face to a small diameter face of the rotor via a first fluid conduit and a second opening fluidly connects the large diameter face to a radially outer portion of the rotor via a second fluid conduit, wherein a circular portion of the large diameter face consists of the two separated openings and a wall separating said openings or wherein a circular portion of the large diameter face consists of portions of the two separated openings and a wall separating said openings and that the first and second openings are bound by at least one circular arc and one or more straight edges.

2. The four-way reversing valve according to claim 1, wherein the first and second openings are of the same size and shape and/or that the first and second openings are of a semi-circular shape.

3. The four-way reversing valve according to claim 1, wherein the wall passes through the centre of the large diameter face and/or that the circular portion is arranged concentrically to the large diameter face and/or that the radius of the circular portion is at least 50%, 66% or 75% of the radius of the large diameter face.

4. The four-way reversing valve according to claim 3, wherein the wall stretches along the entire length of the rotor and separates the first fluid conduit from the second fluid conduit and/or that the wall has a straight cross section close to the large diameter face and/or a curved cross section close to the small diameter face.

5. The four-way reversing valve according to claim 1, wherein the rotor is supported against the housing by means of a pin provided at the centre of the wall, wherein the pin is surrounded by a glide ring and/or that the rotor is dimensioned to balance the pressures occurring at the first fluid conduit and second fluid conduit.

6. The four-way reversing valve according to claim 1, wherein a radially outer portion of the large diameter face or the small diameter face comprises a gear and/or that the large diameter face comprises chamfers at least at some of its interior edges.

7. The four-way reversing valve according to claim 6, wherein the gear is made of a different material than the remainder of the rotor.

8. The four-way reversing valve according to claim 1, wherein a first seal is provided at or close to the small diameter face and/or that an axial glide ring pressed against an O-ring is provided at or close to the large diameter face.

9. The four-way reversing valve according to claim 1, wherein a spring and/or a bearing are provided at or close to the small diameter face, wherein the spring is provided for exerting a force on the rotor in an axial direction of the rotor.

10. The four-way reversing valve according to claim 1, wherein a radially outer portion of the large diameter face or the small diameter face comprises a permanent magnet and/or ferromagnetic material.

11. The four-way reversing valve according to claim 10, wherein a sensor is provided for interacting with the permanent magnet.

12. The four-way reversing valve according to claim 6, wherein a motor is connected to the housing for turning the rotor via the gear.

13. The four-way reversing valve according to claim 11, wherein a radially outer portion of the large diameter face or the small diameter face comprises a gear and/or that the large diameter face comprises chamfers at least at some of its interior edges, wherein a motor is connected to the housing for turning the rotor via the gear, and wherein the sensor is provided close to the motor, such that it is included in a housing of the motor.

14. The four-way reversing valve according to claim 1, wherein the housing comprises an inlet section and an outlet section, wherein the inlet section and the outlet section are connectable to each other via a first flange and/or connectable to each other in different rotary positions with respect to each other, and/or that the housing is made of aluminium or an aluminium alloy.

15. The four-way reversing valve according to claim 14, wherein the large diameter face of the rotor is provided at least partially between the inlet section and the outlet section.

16. The four-way reversing valve according to claim 15, wherein the remainder of the rotor is provided inside the inlet section.

17. The four-way reversing valve according to claim 1, wherein the housing comprises a valve section that is connectable to the inlet section via a second flange.

18. The four-way reversing valve according to claim 1, wherein the discharge port and/or the evaporator port are arranged at 90°±20°, with respect to the suction port.

19. A set comprising two or more four-way reversing valves according to claim 1, wherein the two or more four-way reversing valves are fluidly connected by at least one manifold.

20. The set according to claim 19, wherein at least two identical manifolds are provided.

21. The four-way reversing valve according to claim 8, wherein the first seal is a V-lip seal.

22. The four-way reversing valve according to claim 11, wherein the sensor is a reed sensor, a hall sensor or an inductive sensor.

23. The four-way reversing valve according to claim 12, wherein the motor is a DC gear motor.

24. A set comprising two or more four-way reversing valves according to claim 1, wherein the two or more four-way reversing valves are fluidly connected by exactly three or four manifolds.

* * * * *